US010283847B2

(12) United States Patent
Li et al.

(10) Patent No.: US 10,283,847 B2
(45) Date of Patent: May 7, 2019

(54) ANTENNA DEVICE AND MOBILE DEVICE

(71) Applicant: Wistron NeWeb Corp., Hsinchu (TW)

(72) Inventors: Kuan-Hung Li, Hsinchu (TW); Cheng-Da Yang, Hsinchu (TW); Shang-Ching Tseng, Hsinchu (TW); Yu-Yu Chiang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 15/854,045

(22) Filed: Dec. 26, 2017

(65) Prior Publication Data

US 2019/0027810 A1 Jan. 24, 2019

(30) Foreign Application Priority Data

Jul. 24, 2017 (TW) ..... 106124727 A

(51) Int. Cl.

| | |
|---|---|
| ***H01Q 1/24*** | (2006.01) |
| ***H01Q 1/44*** | (2006.01) |
| ***H01Q 1/48*** | (2006.01) |
| ***H01Q 21/30*** | (2006.01) |
| ***H01Q 5/392*** | (2015.01) |

(52) U.S. Cl.

CPC ..... *H01Q 1/243* (2013.01); *H01Q 1/245* (2013.01); *H01Q 1/44* (2013.01); *H01Q 1/48* (2013.01); *H01Q 5/392* (2015.01); *H01Q 21/30* (2013.01)

(58) Field of Classification Search

CPC H01Q 1/243; H01Q 1/44; H01Q 1/48; H01Q 21/30

See application file for complete search history.

(56) References Cited

U.S. PATENT DOCUMENTS

| | | | | |
|---|---|---|---|---|
| 2003/0122721 | A1* | 7/2003 | Sievenpiper | H01Q 9/14 343/767 |
| 2013/0271333 | A1* | 10/2013 | Taura | H01Q 13/10 343/767 |
| 2017/0033467 | A1 | 2/2017 | Huang et al. | |
| 2017/0207542 | A1* | 7/2017 | Tseng | H01Q 13/10 |
| 2018/0219297 | A1* | 8/2018 | Chen | H01Q 7/00 |

FOREIGN PATENT DOCUMENTS

TW 201703350 A 1/2017

* cited by examiner

*Primary Examiner* — Dieu Hien T Duong
(74) *Attorney, Agent, or Firm* — McClure, Qualey & Rodack, LLP

(57) ABSTRACT

An antenna device includes a metal mechanism element, a ground plane, a feeding element, a grounding extension element, and a dielectric substrate. The metal mechanism element has a slot. The feeding element has a feeding point coupled to a signal source. The feeding element extends across the slot. The grounding extension element is coupled to the ground plane. A vertical projection of the grounding extension element at least partially overlaps the slot. An antenna structure is formed by the feeding element, the grounding extension element, and the slot of the metal mechanism element. The antenna structure is capable of covering a low-frequency band and a high-frequency band. The distance between the feeding point and one end of the slot is less than or equal to 0.1 wavelength of a central frequency of the low-frequency band.

10 Claims, 10 Drawing Sheets

ANTENNA DEVICE AND MOBILE DEVICE

CROSS REFERENCE TO RELATED APPLICATIONS

This Application claims priority to Taiwan Patent Application No. 106124727 filed on Jul. 24, 2017, the entirety of which are incorporated by reference herein.

FIELD OF THE INVENTION

The present invention relates to an antenna device, and more particularly to a mobile device and an antenna device therein.

BACKGROUND OF THE INVENTION

With the advancements being made in mobile communication technology, mobile devices such as portable computers, mobile phones, multimedia players, and other hybrid functional portable electronic devices have become more common. To satisfy consumer demand, mobile devices usually implement wireless communication functions. Some devices cover a large wireless communication area which includes mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area which includes mobile phones using Wi-Fi and Bluetooth systems and using frequency bands of 2.4 GHz, 5.2 GHz, and 5.8 GHz.

In order to improve the appearance, designers often incorporate metal elements into mobile devices. However, the newly added metal elements negatively interact with the antennas incorporated in such mobile devices, thereby degrading their overall wireless communication quality. As a result, there is a need to propose a mobile device with a novel antenna structure, so as to overcome the problems of the conventional art.

SUMMARY OF THE INVENTION

An aspect of the present disclosure is to provide an antenna device. The antenna device includes a metal mechanism element, a ground plane, a feeding element, a grounding extension element and a dielectric substrate. The metal mechanism element has a slot, the slot has a first end and a second end. The ground plane is coupled to the metal mechanism element. The feeding element has a feeding point coupled to a signal source, wherein the feeding element extends across the slot. The grounding extension element is coupled to the ground plane, a vertical projection of the grounding extension element at least partially overlaps the slot. The ground plane, the feeding element and the grounding extension element are disposed on the dielectric substrate, and configured to an antenna structure. The antenna structure is capable of covering a low frequency band and a high frequency band. A distance between the feeding point and the first end of the slot is substantially less than or equal to 0.1 wavelength of the central frequency of the low frequency band, wherein a length of the slot is substantially less than the 0.5 wavelength of the central frequency of the low frequency band.

Another aspect of the present invention is to provide a mobile device. The mobile device includes a RF signal processing unit and an antenna device coupled to the RF signal processing unit. The antenna device includes a metal mechanism element, a ground plane, a feeding element, a grounding extension element and a dielectric substrate. The metal mechanism element has a slot, and the slot has a first end and a second end. The ground plane is coupled to the metal mechanism element. The feeding element has a feeding point coupled to a signal source, wherein the feeding element extends across the slot. The grounding extension element is coupled to the ground plane, a vertical projection of the grounding extension element at least partially overlaps the slot. The ground plane, the feeding element and the grounding extension element are disposed on the dielectric substrate, and configured to an antenna structure. The antenna structure is capable of covering a low frequency band and a high frequency band. A distance between the feeding point and the first end of the slot is substantially less than or equal to 0.1 wavelength of the central frequency of the low frequency band, wherein a length of the slot is substantially less than the 0.5 wavelength of the central frequency of the low frequency band.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1A:
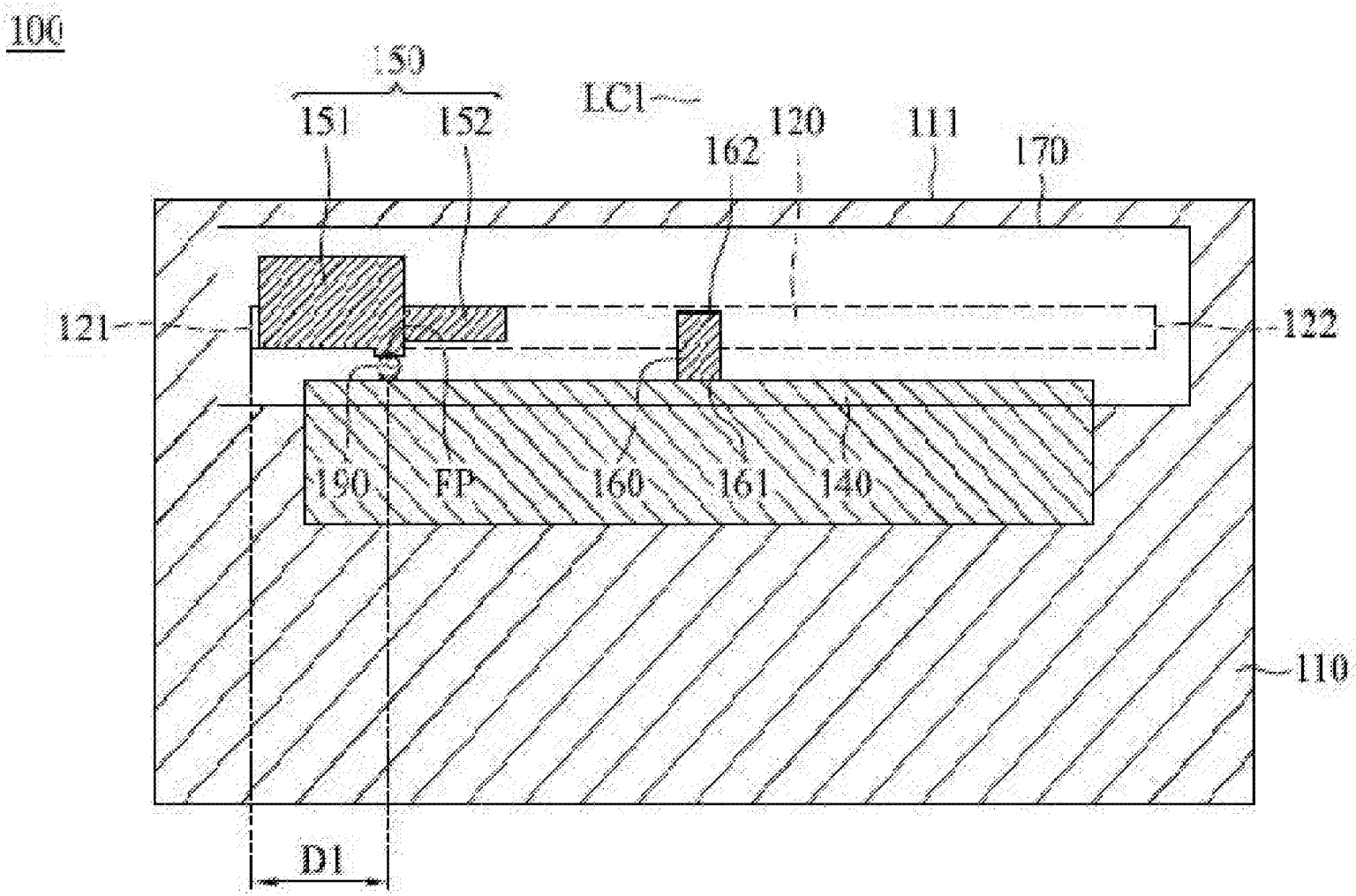
FIG. 1A is a perspective view showing an antenna device according to an embodiment of the present invention.

The structure and technical features of the present invention will now be described in considerable detail with reference to some embodiments and the accompanying drawings thereof, so that the present invention can be easily understood.

Reference will now be made in detail to the present preferred embodiments of the invention, examples of which are illustrated in the accompanying drawings. Wherever appropriate, the same or similar reference numbers are used in the drawings and the description to refer to the same or comparable parts. It is not intended to limit the method or the system by the exemplary embodiments described herein. In the following detailed description, for purposes of explanation, numerous specific details are set forth in order to attain a thorough understanding of the disclosed embodiments. It will be apparent, however, that one or more embodiments may be practiced without these specific details. As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

Figure 1B:
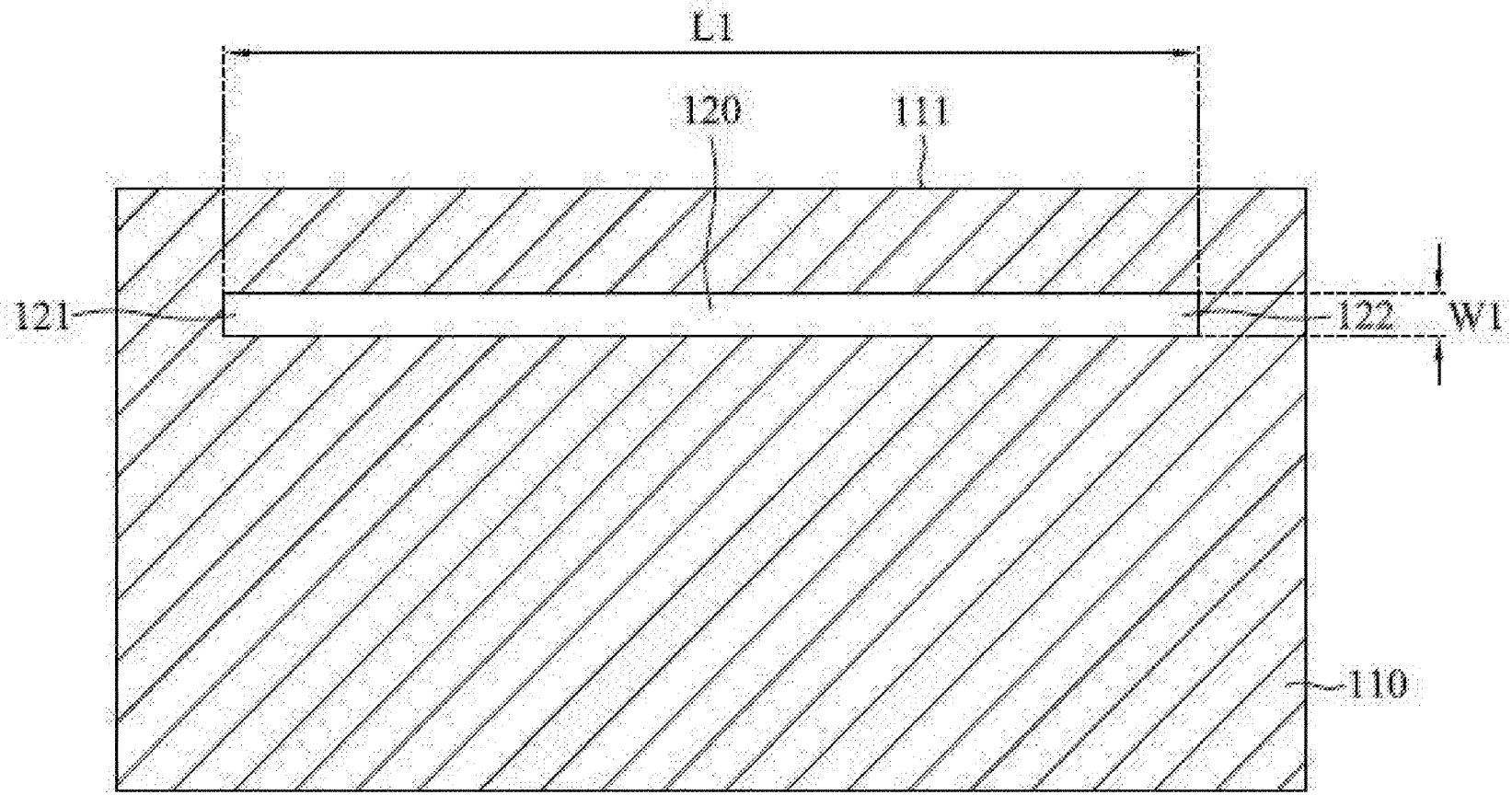
FIG. 1B is a schematic diagram showing the lower portion of an antenna device according to an embodiment of the present invention.
Figure 1C:
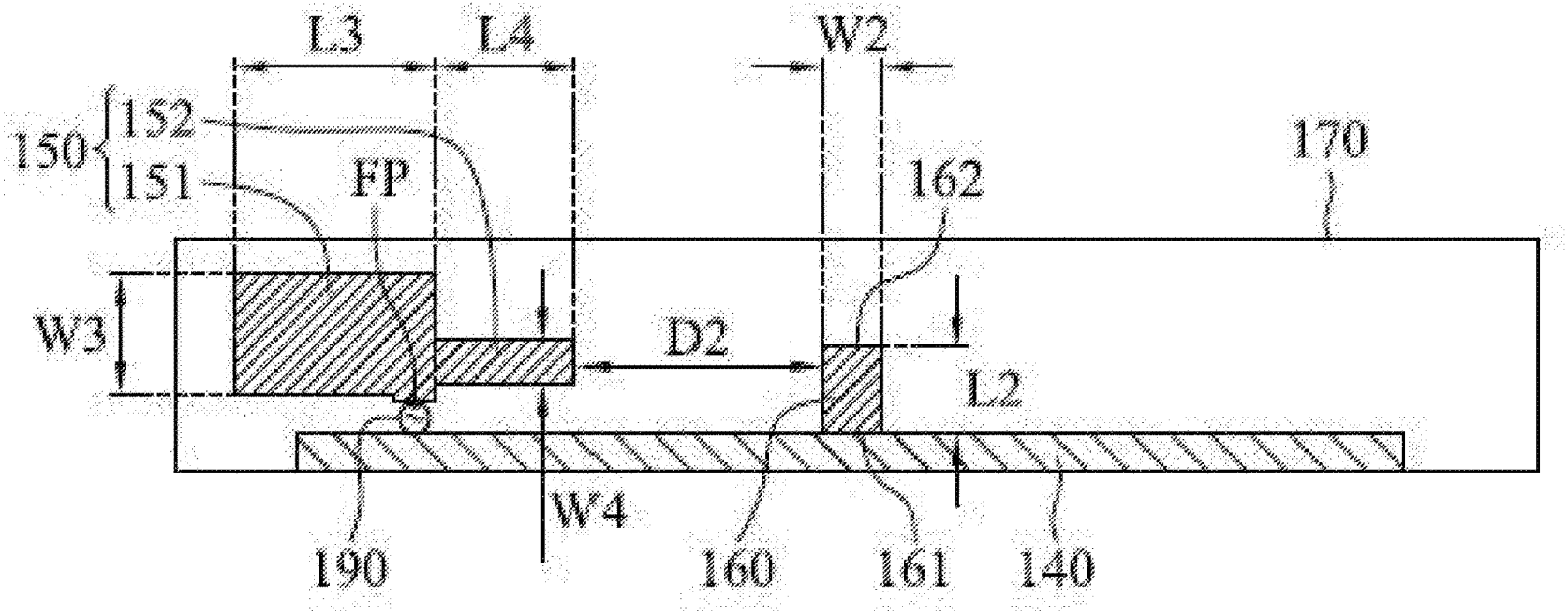
FIG. 1C is a schematic diagram showing the upper portion of an antenna device according to an embodiment of the present invention.
Figure 1D:
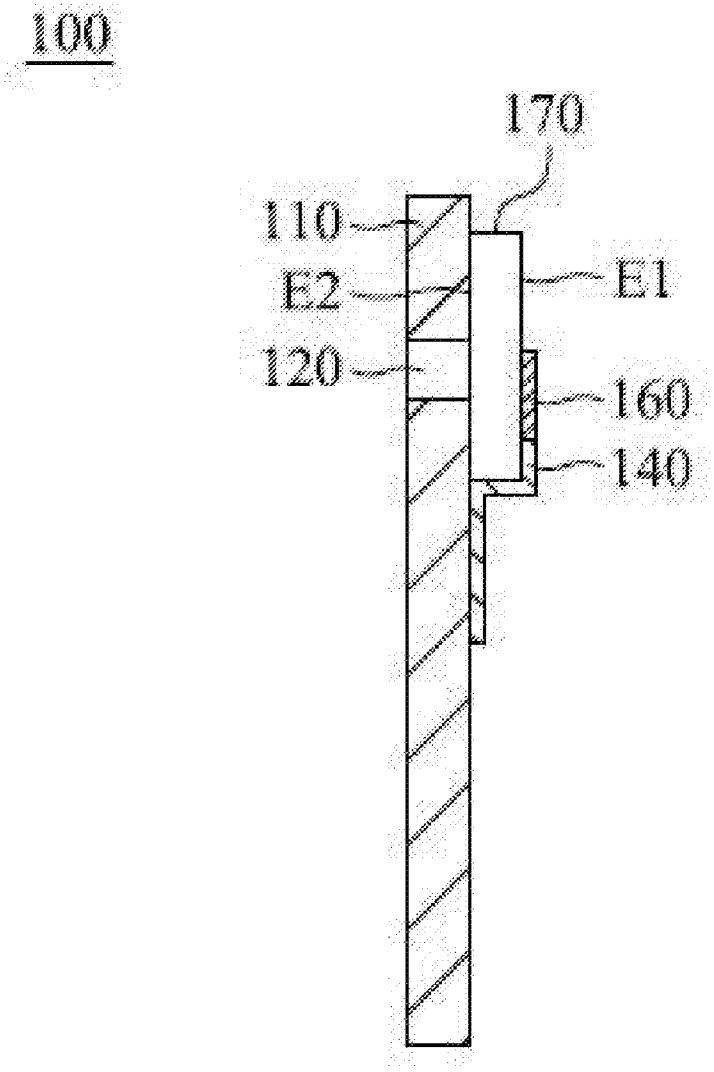
FIG. 1D is a sectional view showing an antenna device according to an embodiment of the present invention.

FIG. 1A is a perspective view showing an antenna device 100 according to an embodiment of the present invention. FIG. 1B is a schematic diagram showing the lower portion of the antenna device 100 according to the embodiment of the present invention. FIG. 1C is a schematic diagram showing the upper portion of the antenna system 100 according to the embodiment of the present invention. FIG. 1D is a sectional view (along section line LC1) showing the antenna device 100 according to an embodiment of the present invention. The antenna device 100 can be applied to a mobile device, for example, a smart phone, a tablet computer, or a notebook computer. As shown in FIGS. 1A, 1B, 1C and 1D, the antenna device 100 includes a metal mechanism element 110, a ground plane 140, a feeding element 150, a grounding extension element 160 and a dielectric substrate 170. It should be noted that the antenna system 100 may further include other components, such as a processor, a touch control panel, a speaker, a battery module and a housing.

The metal mechanism element 110 includes a slot 120, the slot can be substantially a straight strip shape. More specifically, the slot 120 can be a closed slot having a first end 121 and a second end 122 away from each other, the first end 121 and the second end 122 both are closed ends. The slot 120 can be parallel to at least one edge 111 of the metal mechanism element 110. In some embodiments, the antenna device 100 can be applied to a mobile device, the metal mechanism element 110 can either be a metal back cover or a part of a housing of the mobile device.

The ground plane 140, the feeding element 150 and the grounding extension element 160 are made of metal material, such as copper, silver, aluminum, iron, or alloys thereof. The dielectric substrate 170 can be a Flame Retardant 4 (FR4) substrate, a printed circuit board (PCB) or a flexible circuit board (FCB). The dielectric substrate 170 may have a first surface E1 and a second surface E2 opposite to the first surface E1. The ground plane 140, the feeding element 150 and the grounding extension element 160 are disposed on the first surface E1 of the dielectric substrate 170. The second surface E2 of the dielectric substrate 170 may be close to or directly attached to the metal mechanism element 110 (adjacent to or completely covers a side of the slot 120).

The ground plane 140 is coupled to the metal mechanism element 110, both of which may provide a ground potential to the antenna device 100. For example, the ground plane 140 can be a ground copper foil, which may extend from the dielectric substrate 170 onto the metal mechanism element 110. The feeding element 150 includes feeding point FP, the feeding point FP is coupled to a signal source 190. The signal source 190 can be a radio frequency (RF) module, the RF module can be used to generate a transmit signal or to process a receive signal. For example, the positive electrode of the signal source 190 may be coupled to the feeding point FP and the negative electrode of the signal source 190 may be coupled to the ground plane 140. The feeding element extends across the slot 120 of the metal mechanism element 110. For example, a vertical projection of the feeding element 150 on the metal mechanism element 110 may be covering across the slot 120. The grounding extension element 160 is coupled to the ground plane 140, the grounding extension element 160 extends over at least a part of the slot 120 of the metal mechanism element 110. For example, a vertical projection of the grounding extension element 160 on the metal mechanism element 110 at least partially overlaps the slot 120 (i.e. may extend entirely across the slot 120, or extend over only a part of the slot 120).

The feeding element 150 can be a width-varying structure and includes a wide portion 151 and a narrow portion 152. For example, the wide portion 151 of the feeding element 150 can be a rectangular shape having a larger area, and the narrow portion 152 of the feeding element 150 can be a rectangular shape having a smaller area. A vertical projection of the narrow portion 152 of the feeding element 150 on the metal mechanism element 110 at least partially overlaps the slot 120. The wide portion 151 and the narrow portion 152 of the feeding element 150 may substantially extend in opposite directions. The feed point FP may be located approximately at the joint portion of the wide portion 151 and the narrow portion 152 of the feeding element 150. The grounding extension element 160 can substantially be a rectangular shape. The grounding extension element 160 includes a first end 161 and a second end 162, the first end 161 of the grounding extension element 160 is coupled to the ground plane 140, and the second end 162 of the grounding extension element 160 is an open end and extends away from the ground plane 140. A vertical projection of the grounding extension element 160 on the metal mechanism element 110 is substantially located at the middle from the first end 121 to the second end 122 of the slot 120. However, the present invention is not limited thereto. In other embodiments, the location of the grounding extension element 160 can be adjusted based on actual requirements to create different boundary conditions. In other embodiments, the feeding element 150, the grounding extension element 160 and the metal mechanism element 110 are configured to an antenna structure.

Figure 2:
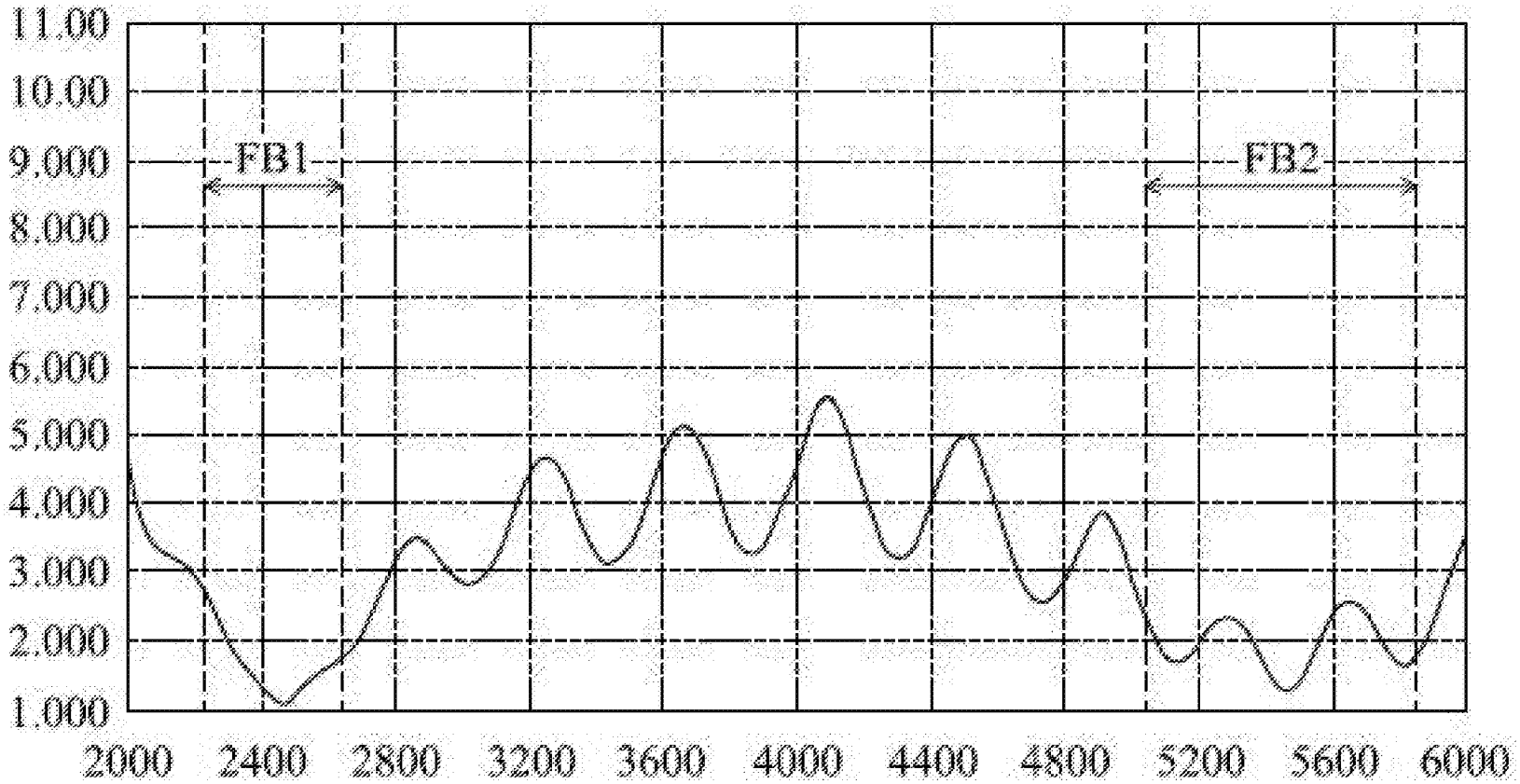
FIG. 2 is a diagram showing the voltage standing wave ratio (VSWR) of the antenna structure of an antenna device according to an embodiment of the present invention.

FIG. 2 is a diagram showing the voltage standing wave ratio (VSWR) of the antenna structure of an antenna device 100 according to an embodiment of the present invention. The horizontal axis represents the operation frequency (MHz), and the vertical axis represents the VSWR. According to the measurement of FIG. 2, when receiving or transmitting a wireless signal, the antenna device 100 is capable of covering a low frequency band FB1 and a high frequency band FB2, in which the low frequency band FB1 is from 2310 MHz to 2680 MHz and the high frequency band FB2 is from 5080 MHz to 5860 MHz. Therefore, the antenna device 100 is fully capable of providing dual-band operations of WLAN (Wireless Local Area Network) 2.4 GHz/5 GHz.

In some embodiments, the operating principle of the antenna structure of the antenna device 100 may be as follows. The feeding element 150, the ground extension element 160 and the slot 120 of the metal mechanism element 110 are excited to generate the aforementioned low-frequency band FB1, the feeding element 150 is individually excited to generate the aforementioned high-frequency band FB2. It should be noted that a distance D1 between the feeding point FP of the feeding element 150 and the first end 121 of the slot 120 is less than or equal to 0.1 wavelength (0.1λ) of a central frequency of the low frequency band FB1 to form a mechanism of side-feeding. The side-feeding means that the feeding point FP of the feeding element 150 is closer to the first end 121 of the slot 120 than to the center of the slot 120, it is different from conventional centre-feeding mechanisms. According to the actual measurement results, this side-feeding mechanism can change the current distribution in the vicinity of the slot 120 of the metal mechanism element 110 and help concentrate the radiation energy of the antenna structure. With such a design, the size of the slot 120 can be smaller than the size of conventional slot antennas. More specifically, a length L1 of the slot 120 can be substantially less than the 0.5 wavelength (0.5λ) of the central frequency of the low frequency band. In some embodiments, a length L1 of the slot 120 can be substantially less than the 0.375 wavelength (0.375λ) of the central frequency of the low frequency band. That is, the overall size of the slot 120 can be reduced by about 25%. The grounding extension element 160 can at least partially cover the slot 120, so as to fine tune the impedance matching of the low frequency band FB1. For example, if a length L2 of the grounding extension element 160 becomes larger, the low frequency band FB1 will drift toward a relatively low frequency. Conversely, if the length L2 of the grounding extension element 160 becomes smaller, the low frequency band FB1 will drift toward a relatively high frequency. The narrow portion 152 of the feeding element can at least partially cover the slot 120, so as to fine tune the impedance matching of the high frequency band FB2. For example, if a length L4 of the narrow portion 152 becomes bigger, the high frequency band FB2 will drift toward a relatively low frequency. Conversely, if the length L4 of the narrow portion 152 becomes smaller, the high frequency band FB2 will drift toward a relatively high frequency. In some embodiments, the narrow portion 152 can be removed (that is, the length L4 can be zero), so that the feeding element 150 includes only the wide portion 151 and can be substantially a rectangular shape.

Figure 3:
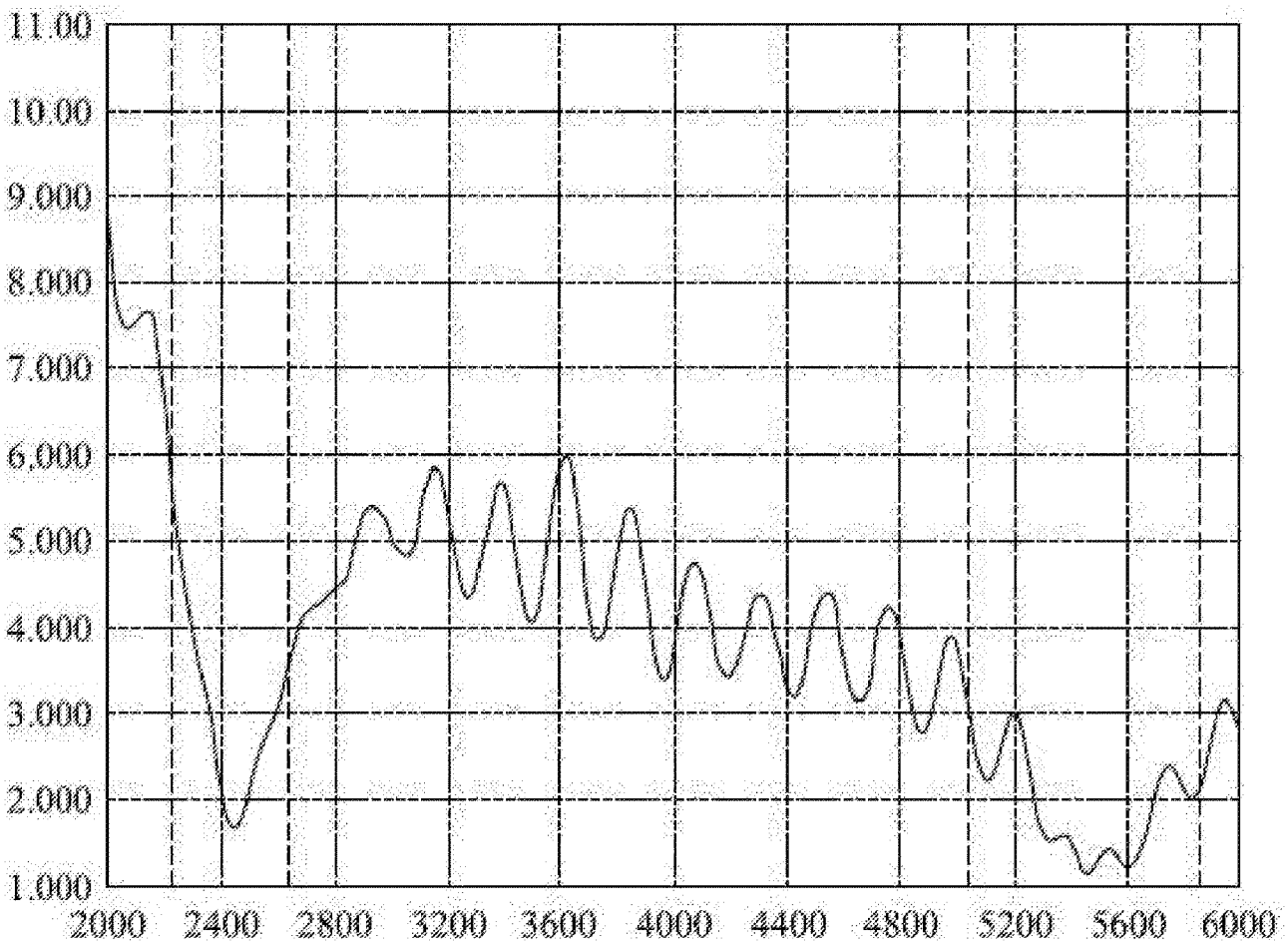
FIG. 3 is a diagram showing the VSWR of a conventional slot antenna.

FIG. 3 is a diagram showing the VSWR of a conventional slot antenna. The horizontal axis represents the operation frequency (MHz), and the vertical axis represents the VSWR. Conventional slot antennas generally use a centre-feeding mechanism, where the length of the slot must be equal to 0.5 wavelength (0.5λ) of the operating frequency so that the total antenna size will be larger than the present invention. In addition, according to the measurement results of FIG. 3, the low frequency bandwidth of the conventional slot antenna is also narrower than that of the present invention.

Figure 4:
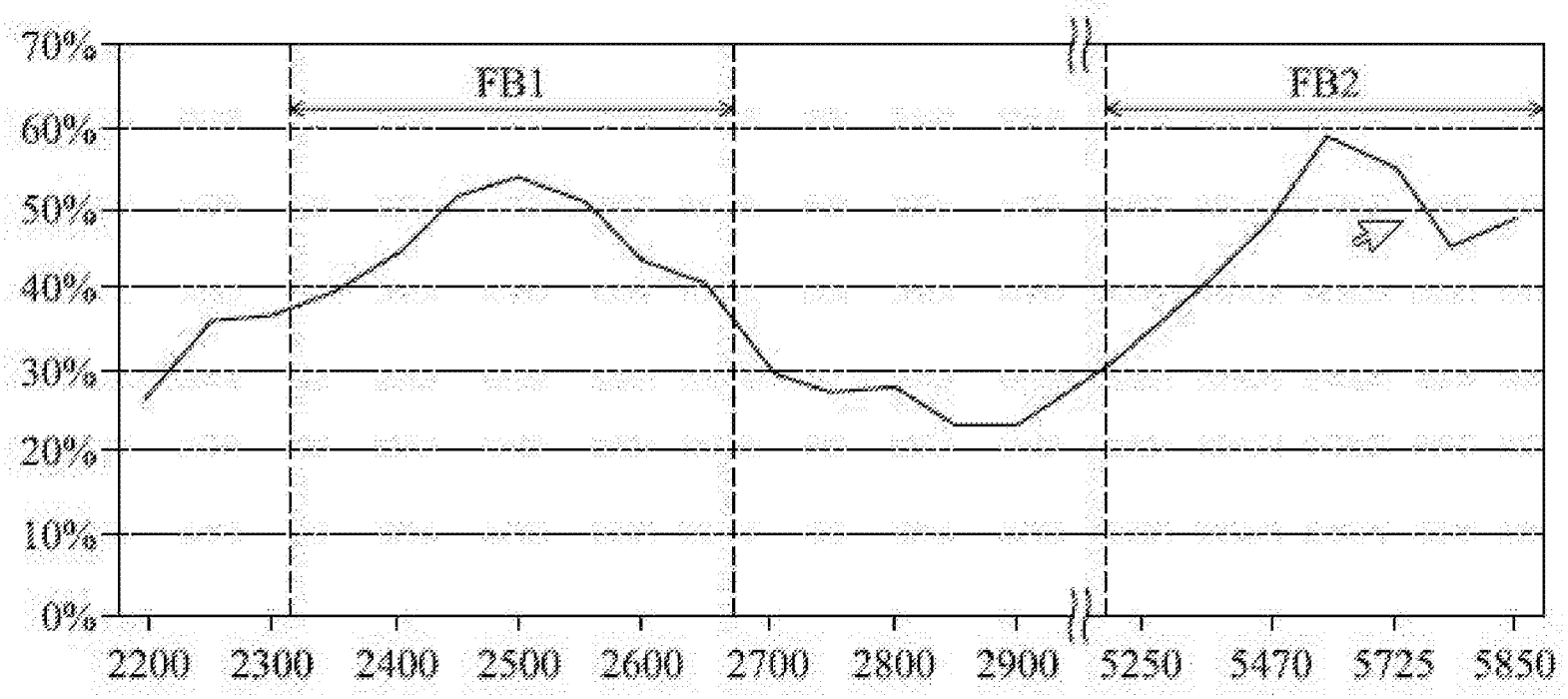
FIG. 4 is a diagram showing the antenna efficiency of an antenna structure of an antenna device according to an embodiment of the present invention.

FIG. 4 is a diagram showing the antenna efficiency of an antenna structure of the antenna device 100 according to an embodiment of the present invention. The horizontal axis represents the operation frequency (MHz), and the vertical axis represents efficiency (%). According to measurement results of FIG. 4, the antenna efficiency of the antenna structure of the antenna device 100 is about 40% or more in the low-frequency band FB1, and the antenna efficiency is about 50% or more in the high-frequency band FB2, indicating that the antenna device 100 of the present invention meets the practical application requirements of the general mobile communication device.

In some embodiments, the element sizes of the antenna device 100 may be as follows. The width W1 of the slot may be about 1.8 mm. The length L2 of the grounding extension element 160 may be from 0 wavelength (0λ) to ⅛ wavelength (λ/8) of the central frequency of the low frequency band FB1. In some embodiments, the length L2 of the grounding extension element 160 may be 1/24 wavelength (λ/24) of the central frequency of the low frequency band FB1. The width W2 of the grounding extension element 160 may be about 2.1 mm. The length L3 of the wide portion 151 of the feeding element 150 may be substantially 0.25 wavelength (0.25λ) of the central frequency of the high frequency band FB2. The width W3 of the wide portion 151 of the feeding element 150 may be about 4.2 mm. The length L4 of the narrow portion 152 of the feeding element 150 may be from 0 wavelength (0λ) to ⅓ wavelength (λ/3) of the central frequency of the high frequency band FB2. In some embodiments, the length L4 of the narrow portion 152 of the feeding element 150 may be ⅙ wavelength (λ/6) of the central frequency of the high frequency band FB2. The width W4 of the narrow portion 152 of the feeding element 150 may be about 1.6 mm. A distance D2 between the narrow portion 152 of the feeding element 150 and the grounding extension element 160 may be between 8 mm and 10 mm, and in some embodiments, the distance D2 may be 9 mm.

Figure 5:
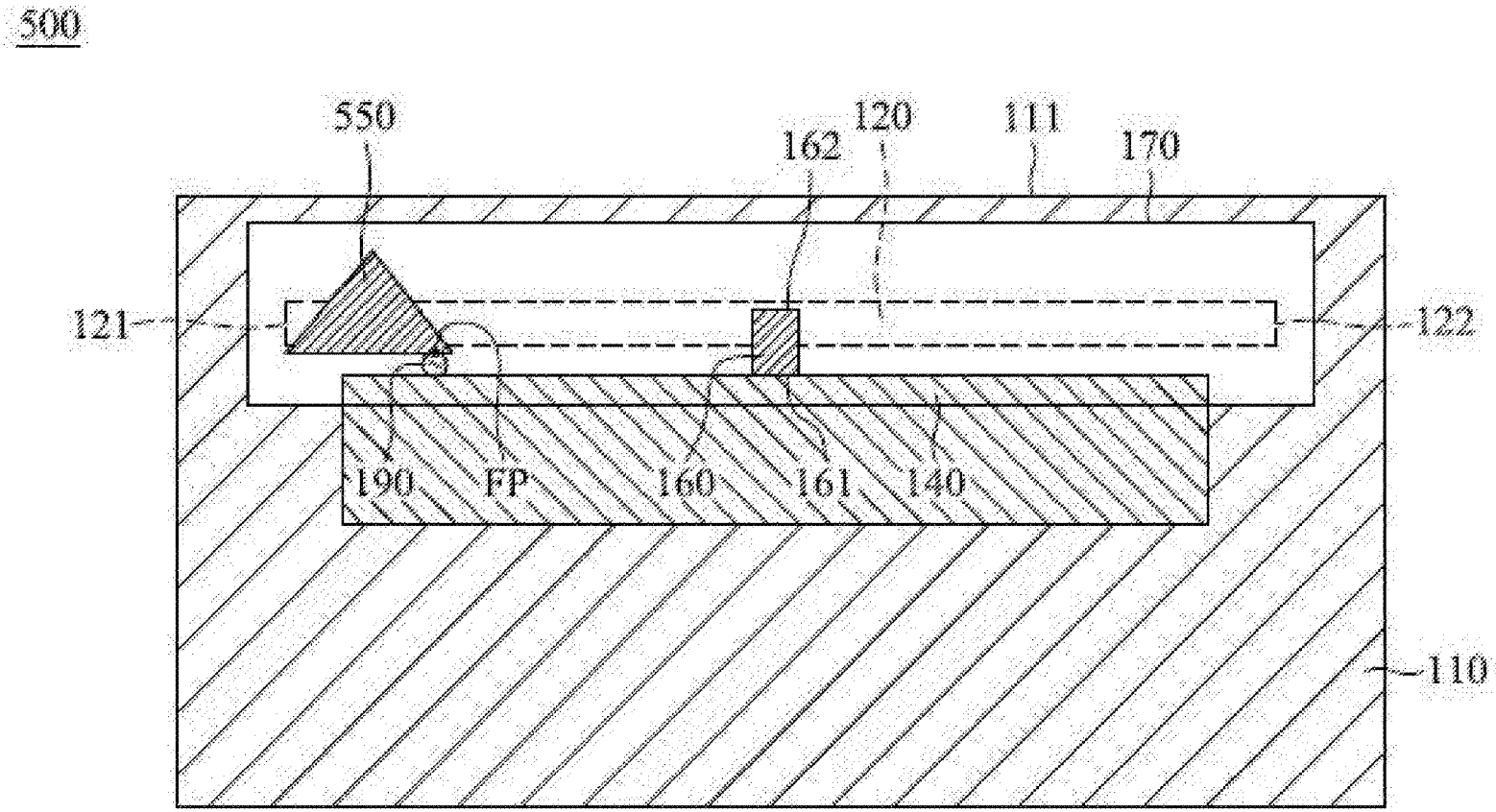
FIG. 5 is a perspective view showing an antenna device according to an embodiment of the present invention.

FIG. 5 is a perspective view showing an antenna device 500 according to an embodiment of the present invention. A feeding element 550 of the antenna device 500 may be substantially a triangle shape, and a feeding point FP is located substantially at one of the three apexes of the triangle shape. A vertical projection of the feeding element 550 on the metal mechanism element 110 may at least partially overlap the slot 120, where the feeding element 550 can be adjusted to fine tune the impedance matching of the high frequency band FB2. Other features of the antenna device 500 of FIG. 5 are similar to those of the antenna device 100 of FIGS. 1A-1D. Accordingly, the two embodiments can achieve similar levels of performance.

Figure 6:
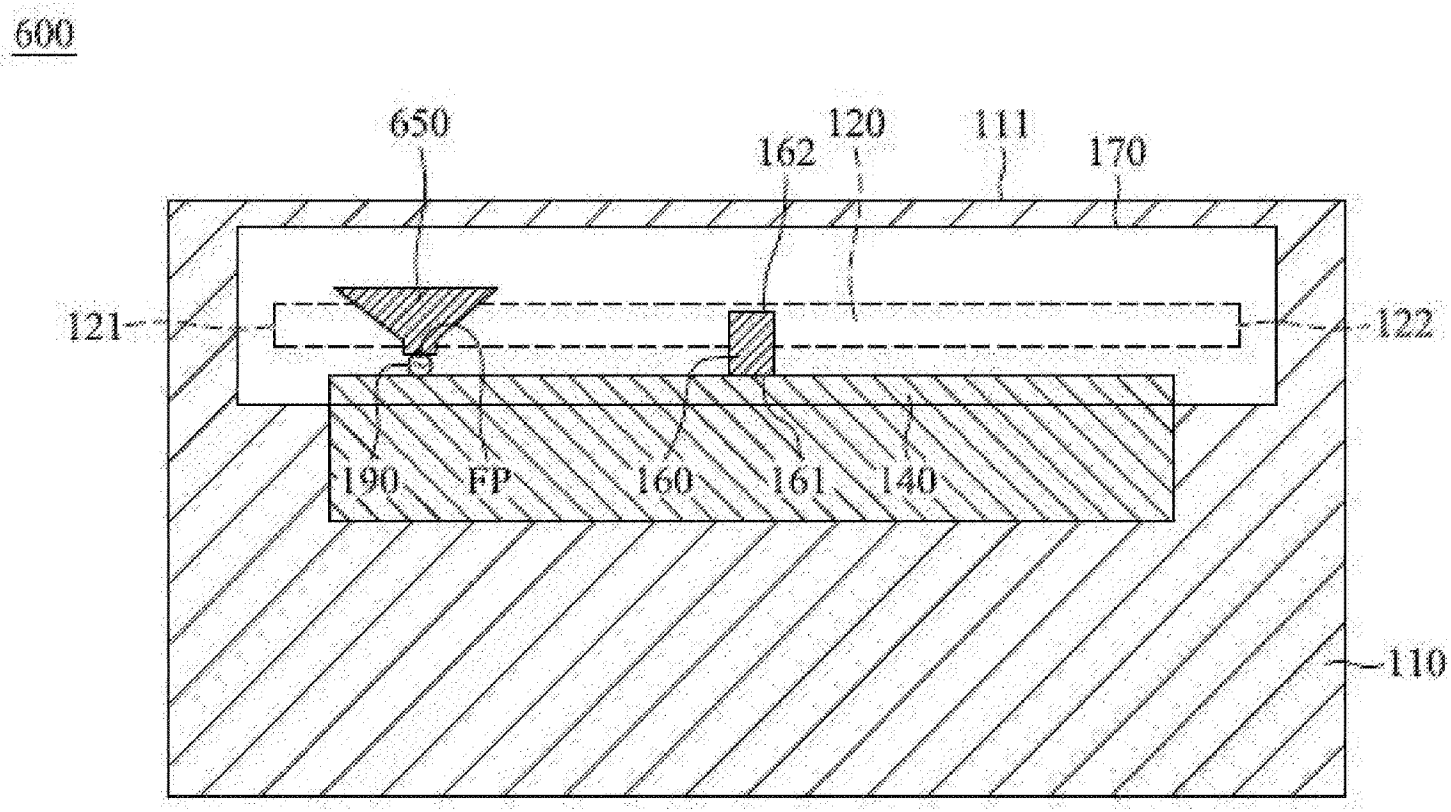
FIG. 6 is a perspective view showing an antenna device according to an embodiment of the present invention.

FIG. 6 is a perspective view showing an antenna device 600 according to an embodiment of the present invention. A feeding element 650 of the antenna device 600 may be substantially an inverted trapezoid shape, and a feeding point FP is located approximately at the shorter side of the two parallel sides of the inverted trapezoid shape. A vertical projection of the feeding element 650 on the metal mechanism element 110 may at least partially overlap the slot 120, where the feeding element 650 can be adjusted to fine tune the impedance matching of the high frequency band FB2. Other features of the antenna device 600 of FIG. 6 are similar to those of the antenna device 100 of FIGS. 1A-1D. Accordingly, the two embodiments can achieve similar levels of performance.

Figure 7:
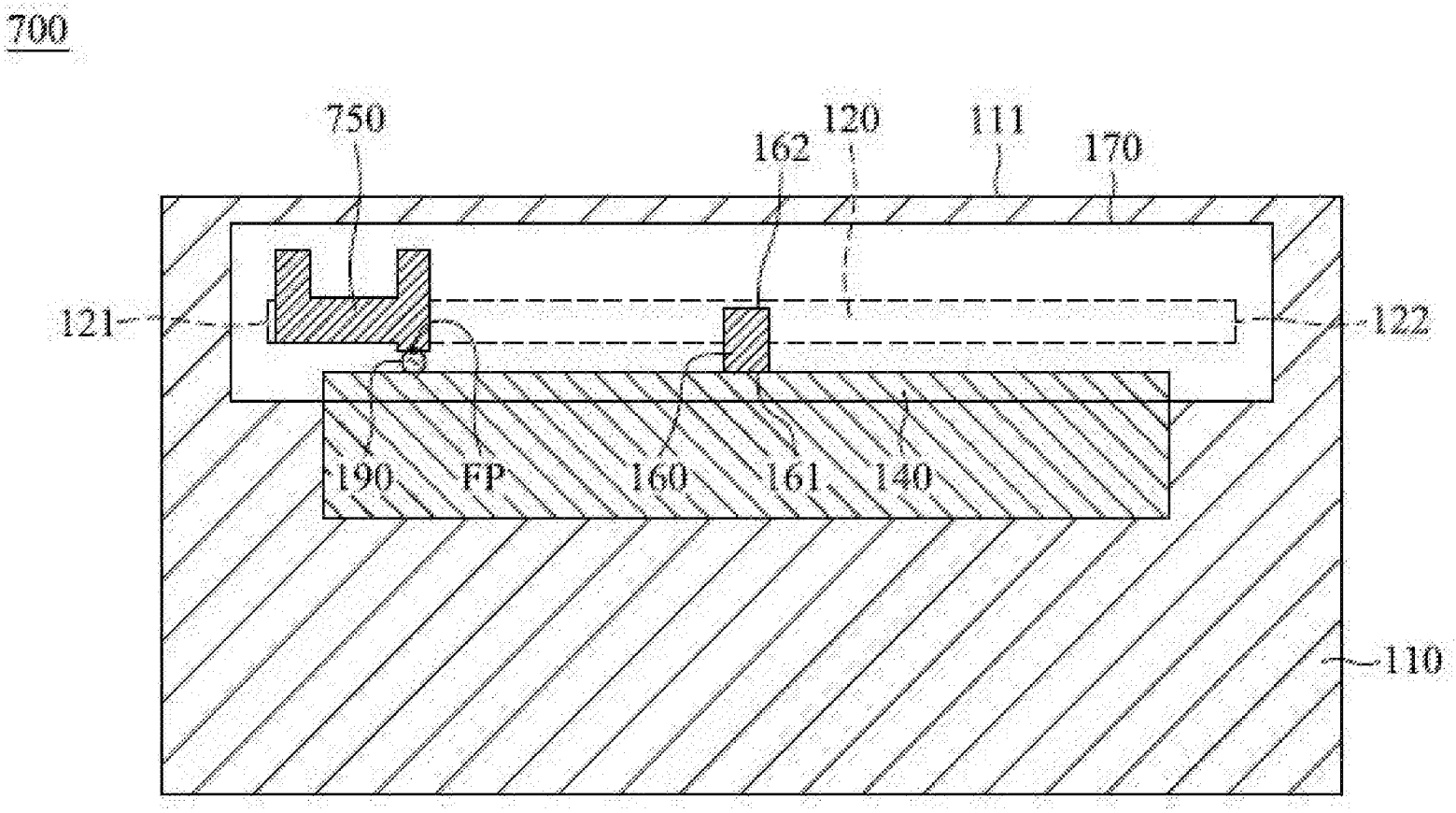
FIG. 7 is a perspective view showing an antenna device according to an embodiment of the present invention.

FIG. 7 is a perspective view showing an antenna device 700 according to an embodiment of the present invention. A feeding element 750 of the antenna device 700 may be substantially a U shape, and a feeding point FP is located approximately at one of two right-angle transitions of this U-shape. A vertical projection of the feeding element 750 on the metal mechanism element 110 may at least partially overlap the slot 120, where the feeding element 750 can be adjusted to fine tune the impedance matching of the high frequency band FB2. Other features of the antenna device 700 of FIG. 7 are similar to those of the antenna device 100 of FIGS. 1A-1D. Accordingly, the two embodiments can achieve similar levels of performance.

According to various embodiments of the present invention, the feeding element 150 can be other different shapes, for example, a circular shape, an ellipse shape or an irregular shape. An antenna designer of ordinary skill in the art can modify the shapes of the feeding element 150 to achieve the effect of increasing the operating bandwidth of the antenna structure.

The invention proposes a novel antenna structure including side-feeding mechanism, it can concentrate the radiation energy of the antenna structure and reduce the overall size of the antenna structure simultaneously. When the antenna structure is applied to a mobile device having a metal mechanism element, the metal mechanism element can be considered as an extension of the antenna structure, so as to avoid negative impact on mobile device communication quality caused by the metal mechanism element. The invention has the advantages of small size, broadband and beautifying the appearance of the device, so that it is very suitable for being applied to various kinds of mobile communication devices.

Note that the above element sizes, element parameters, element shapes, and frequency ranges are not limitations of the invention, unless otherwise expressly embodied in the claims. An antenna designer of ordinary skill in the art can fine-tune these settings or values according to different requirements. An antenna designer of ordinary skill in the art can fine-tune these settings or values according to different requirements. It should be understood that the antenna structure of the invention is not limited to the configurations of FIGS. 1-7. The invention may merely include any one or more features of any one or more embodiments of FIGS. 1-7. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna device, comprising:

a metal mechanism element having a slot, wherein the slot has a first end and a second end;

a ground plane coupled to the metal mechanism element;

a feeding element having a feeding point coupled to a signal source, wherein the feeding element is extended across the slot;

a grounding extension element coupled to the ground plane, wherein a vertical projection of the grounding extension element at least partially overlaps the slot; and a dielectric substrate, wherein the grounding element, the feeding element and the grounding extension element are disposed on the dielectric substrate;

wherein the feeding element, the grounding extension element and the slot of the metal mechanism element are configured to an antenna structure, wherein the antenna structure is capable of operating in a low frequency band and a high frequency band, a distance between the feeding point and the first end of the slot is substantially less than or equal to 0.1 wavelength of the central frequency of the low frequency band, and wherein a length of the slot is substantially equal to 0.375 wavelength of the central frequency of the low frequency band.

2. The antenna device as claimed in claim 1, wherein the slot is a straight strip shape, the first end of the slot and the second end of the slot are closed ends.

3. The antenna device as claimed in claim 1, wherein the low frequency band covers 2310 MHz to 2680 MHz, and the high frequency covers 5080 MHz to 5860 MHz.

4. The antenna device as claimed in claim 1, wherein the feeding element, the ground extension element and the slot of the metal mechanism element are configured to be excited to generate the low frequency band, the feeding element is configured to be excited to generate the high frequency band.

5. The antenna device as claimed in claim 1, wherein the ground extension element is a rectangular shape.

6. The antenna device as claimed in claim 1, wherein the feeding element is a rectangular shape, a triangle shape, an inverted trapezoid shape, or a U shape.

7. The antenna device as claimed in claim 1, wherein the feeding element has a wide portion and a narrow portion, a vertical projection of the narrow portion at least partially overlaps the slot.

8. A mobile device, comprising:

an RF signal processing unit, and an antenna device coupled to the RF signal processing unit, the antenna device comprising:

a metal mechanism element having a slot, wherein the slot has a first end and a second end;

a ground plane coupled to the metal mechanism element;

a feeding element having a feeding point coupled to a signal source, wherein the feeding element is extended across the slot;

a grounding extension element coupled to the ground plane, wherein a vertical projection of the grounding extension element at least partially overlaps the slot; and a dielectric substrate, wherein the grounding element, the feeding element and the grounding extension element are disposed on the dielectric substrate;

wherein the feeding element, the grounding extension element and the slot of the metal mechanism element are configured to an antenna structure, wherein the antenna structure is capable of operating in a low frequency band and a high frequency band, a distance between the feeding point and the first end of the slot is substantially less than or equal to 0.1 wavelength of the central frequency of the low frequency band, and wherein a length of the slot is substantially equal to 0.375 wavelength of the central frequency of the low frequency band.

9. The mobile device as claimed in claim 8, wherein the metal mechanism element is a metal back cover of the mobile device.

10. The mobile device as claimed in claim 8, wherein the metal mechanism element is a part of a housing of the mobile device.

* * * * *